US006179438B1

(12) United States Patent
Parker

(10) Patent No.: US 6,179,438 B1
(45) Date of Patent: Jan. 30, 2001

(54) CHARGEABLE FLASHLIGHT

(75) Inventor: David Parker, Torrance, CA (US)

(73) Assignee: Pelican Products, Inc., Torrance, CA (US)

( * ) Notice: Under 35 U.S.C. 154(b), the term of this patent shall be extended for 0 days.

(21) Appl. No.: 09/343,571

(22) Filed: Jun. 30, 1999

(51) Int. Cl.[7] ..... F21L 4/08
(52) U.S. Cl. ..... 362/183; 362/206
(58) Field of Search ..... 362/183, 202, 362/205, 206; 320/113–115

(56) References Cited

U.S. PATENT DOCUMENTS

| | | | | |
|---|---|---|---|---|
| D. 282,289 | | 1/1986 | Verdier | D26/46 |
| D. 351,675 | | 10/1994 | Sharrah et al. | D26/38 |
| D. 353,216 | | 12/1994 | Sharrah et al. | D26/37 |
| D. 394,122 | | 5/1998 | Concari et al. | D26/38 |
| 1,680,169 | | 8/1928 | Osean | 362/188 |
| 2,016,819 | | 10/1935 | Meginniss | 362/158 |
| 2,097,222 | | 10/1937 | Tompkins et al. | 362/187 |
| 2,272,907 | | 2/1942 | Deibel | 362/194 |
| 2,312,463 | | 3/1943 | Zdansky | 362/183 |
| 2,339,356 | | 1/1944 | Sachs | 362/187 |
| 2,813,265 | | 11/1957 | Finks | 340/473 |
| 2,931,005 | | 3/1960 | Saurwein et al. | 439/660 |
| 2,945,944 | | 7/1960 | Gillespie | 362/188 |
| 3,217,224 | | 11/1965 | Sherwood | 320/115 |
| 3,643,083 | * | 2/1972 | Heine | 362/206 |
| 3,659,180 | | 4/1972 | Urbush | 320/115 |
| 3,787,678 | | 1/1974 | Rainer | 362/183 |
| 3,825,740 | | 7/1974 | Friedman et al. | 362/183 |
| 3,829,676 | | 8/1974 | Nelson et al. | 362/183 |
| 4,060,723 | | 11/1977 | Nelson | 362/205 |
| 4,092,580 | | 5/1978 | Prinsze | 320/115 |
| 4,171,534 | * | 10/1979 | Strowe | 362/183 |
| 4,203,150 | | 5/1980 | Shamlian | 362/183 |
| 4,225,814 | | 9/1980 | Gantz et al. | 320/115 |
| 4,265,984 | | 5/1981 | Kaye | 429/178 |
| 4,286,311 | | 8/1981 | Maglica | 362/205 |
| 4,325,107 | | 4/1982 | MacLeod | 362/183 |
| 4,345,304 | | 8/1982 | Penney et al. | 362/183 |
| 4,463,283 | | 7/1984 | Penney et al. | 315/87 |
| 4,472,766 | | 9/1984 | Hung | 362/158 |
| 4,495,551 | | 1/1985 | Foltz | 362/205 |

(List continued on next page.)

FOREIGN PATENT DOCUMENTS

| | | |
|---|---|---|
| 0 768 724 A2 | 4/1997 | (EP) . |
| 0 679 237 B1 | 9/1997 | (EP) . |
| 2 372 382 | 11/1976 | (FR) . |
| 411218 | 6/1934 | (GB) . |

OTHER PUBLICATIONS

Advertisement for Mini Tekna–Lite No date.
Advertisement for Pro–Charger Systems No date.
Advertisement for Tekna flashlights (Golderbergs?) No date.
Law & Order; Apr. 1987 p. 26.
Vari–Probe Code Four Adapter No date.
Lumilite advertisement No date.

* cited by examiner

*Primary Examiner*—Alan Cariaso
(74) *Attorney, Agent, or Firm*—Oppenheimer, Wolff & Donnelly LLP

(57) ABSTRACT

A flashlight includes a rechargeable battery and is loaded from the front. The contacts are on an intermediate portion above the barrel, and are to make connection with contacts of a recharging device having a receiving ring for the body and intermediate portion of the flashlight. There is a helical spring member between the switching device at the base of the barrel and the bottom of the battery and a helical spring member on the base of the barrel at the bottom of the battery. An enlarged head is located above the barrel and the intermediate portion is between the head and the barrel. The intermediate portion receives a housing for holding the bulb, and there are several helical springs associated with the housing.

27 Claims, 5 Drawing Sheets

U.S. PATENT DOCUMENTS

| | | | | |
|---|---|---|---|---|
| 4,777,582 | | 10/1988 | Sharrah | 362/205 |
| 4,819,139 | | 4/1989 | Thomas | 362/183 |
| 4,819,141 | | 4/1989 | Maglica et al. | 362/207 |
| 4,843,298 | | 6/1989 | Brauch et al. | 320/115 |
| 4,843,526 | | 6/1989 | Price, III | 362/187 |
| 4,870,550 | | 9/1989 | Uke | 362/158 |
| 4,888,670 | | 12/1989 | Sharrah | 362/205 |
| 4,890,203 | * | 12/1989 | Watson | 362/202 |
| 4,899,265 | | 2/1990 | Maglica | 362/187 |
| 4,942,505 | | 7/1990 | Maglica | 362/187 |
| 4,970,073 | | 11/1990 | Arzur et al. | 429/152 |
| 5,008,785 | | 4/1991 | Maglica et al. | 362/183 |
| 5,165,048 | | 11/1992 | Keller et al. | 320/113 |
| 5,171,086 | | 12/1992 | Baloochi | 362/188 |
| 5,422,798 | * | 6/1995 | Osiecki et al. | 362/206 |
| 5,432,689 | | 7/1995 | Sharrah et al. | 362/183 |
| 5,461,551 | * | 10/1995 | Clayton | 362/183 |
| 5,486,432 | | 1/1996 | Sharrah et al. | 429/99 |
| 5,629,105 | * | 5/1997 | Matthews | 362/206 |
| 5,772,309 | * | 6/1998 | Groben | 362/183 |

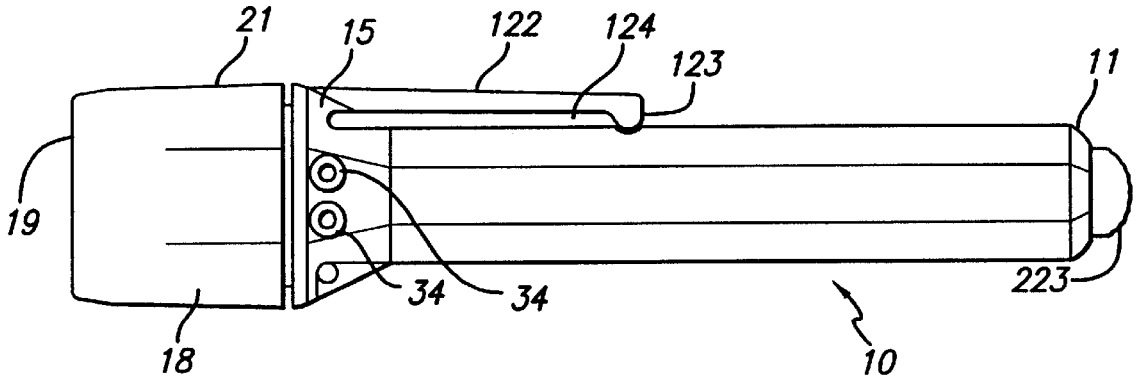
FIG. 1B
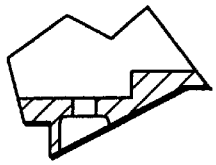
FIG. 4
FIG. 3
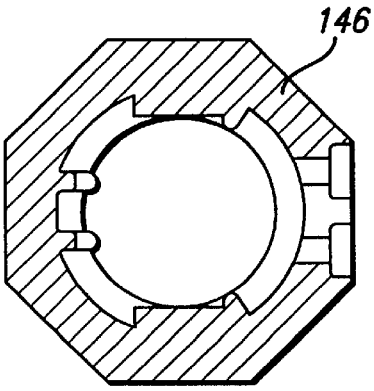
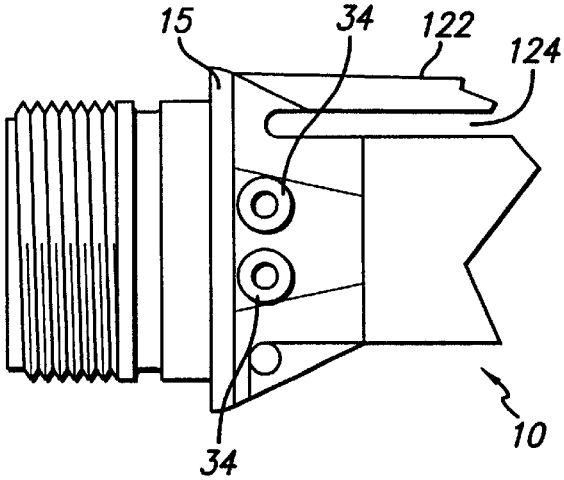
FIG. 2

CHARGEABLE FLASHLIGHT

RELATED APPLICATIONS

This application relates to patent application Ser. No. 09/345,187, filed contemporaneously with this application, entitled "A FLASHLIGHT AND CHARGING SYSTEM" and Ser. No. 09/343,570, filed contemporaneously with this application, entitled "FLASHLIGHT AND CHARGER". The contents of these applications are incorporated by reference herein.

BACKGROUND OF THE INVENTION

This invention relates to a rechargeable flashlight. In particular, it relates to a flashlight for use in relatively rugged conditions.

Many flashlight configurations are known. Additionally, different flashlight configurations are known which are rechargeable. There are also different forms of recharging device for use with flashlights. The different combinations provide for a configuration of flashlight and recharging mechanism, which is not as optimum as possible in the sense that the flashlight and charger can be easily set up as a unit. Moreover, they are not convenient for rugged use, for instance, by law enforcement officers, the military and firefighters.

The various flashlights are often not as simple and inexpensive to manufacture as desirable, while at the same time having effective characteristics of longevity and ability to work in harsh conditions and being subjected to shock, and the need for quick recharging as necessary.

The invention is directed to providing a flashlight and recharging system which minimizes the disadvantages of known flashlights.

SUMMARY OF THE INVENTION

By the present invention, there is provided a flashlight which minimizes the disadvantages of known flashlights.

A rechargeable battery flashlight is provided which is loaded from the front. The flashlight has a body with a barrel, an intermediate section above the body, and a head above the intermediate section. There are contacts on the intermediate portion above the barrel. A switch device is located at the bottom of the barrel. A pair of helical springs are located on the underside of a housing for the bulb of the flashlight, peripherally relative to the housing. Above the housing and below the bulbs there is also a centrally located helical spring. These springs are located at the top of the battery.

At the bottom of the battery there is a switch device and a helical spring. The opposite helical springs retain the battery in a shock absorbing mode. The helical spring at the bottom is located effectively between the base of the barrel and the bottom of the battery.

The helical springs at the top are located at a circumferential position and centrally between the battery and the housing which is mounted in an intermediate section above the barrel of the flashlight.

Above the intermediate section there is located the enlarged head which includes a lens and the bulb. A diode is located between the bulb and one of the peripherally located helical springs.

A charger is provided to connect with the contacts on the intermediate portion when in recharging mode. The charger device includes a circumferential housing which preferably engage the flashlight around the barrel so that the contacts on the charger can make electrical contacts of the flashlight.

The outside of the barrel is octagonal, and has one face which is irregular in width relative to the other faces.

The invention is further described with reference to the accompanying drawings.

BRIEF DESCRIPTION OF THE DRAWINGS

FIG. 1B is a side view of the flashlight.

FIG. 2 is a side view of a portion of the flashlight barrel and intermediate portion showing the contacts on the intermediate portion.

FIG. 3 is a cross-sectional side view of a portion of the flashlight intermediate section.

FIG. 4 is a sectional view of part of the intermediate section with the locations for the contacts.

DETAILED DESCRIPTION OF THE PREFERRED EMBODIMENT

Figure 5:
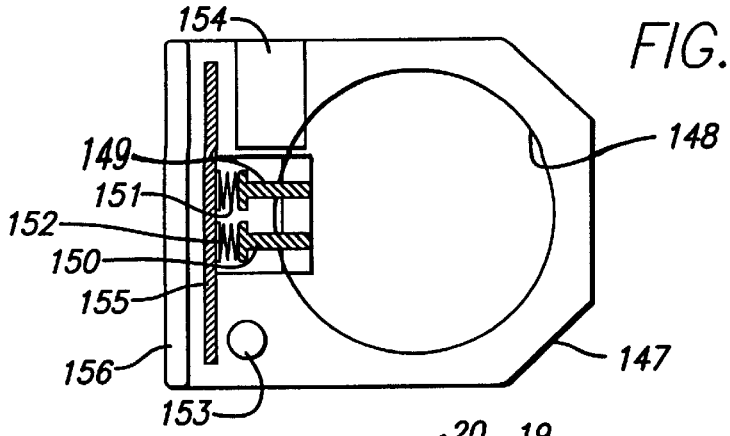
FIG. 5 is a view from the top of the ring of the charger device.

A rechargeable flashlight including a body 10 which has a substantially irregular outer cross-sectional octagonal area or face as defined between the base 11 of the body 10 and the top portion of the body as defined in the area 12. The first cross-sectional area is defined on the outside by an irregular octagonal configuration 13 and the internal configuration is formed substantially as a circular structure 14.

Figure 1A:
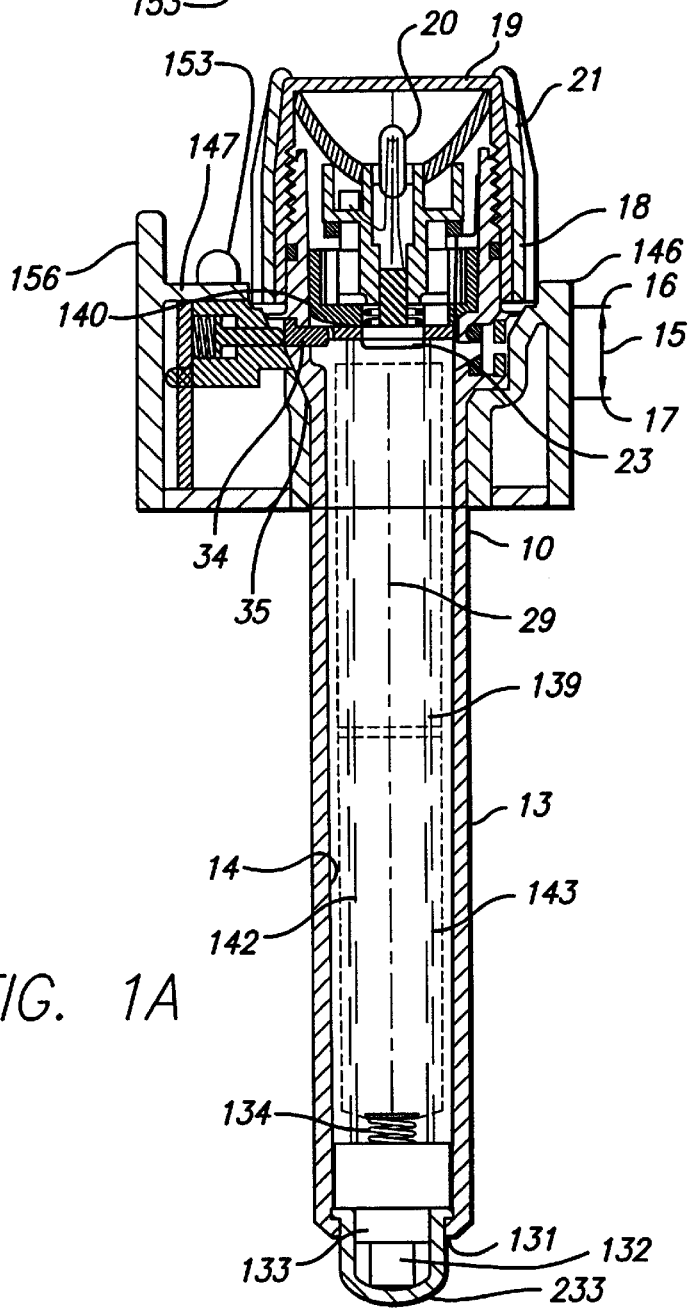
FIG. 1A is a cross-sectional view of a flashlight in accordance with the invention showing the body which includes the barrel and intermediate section above the barrel and an enlarged head above the intermediate section. A battery pack is shown in the barrel, and the charger is located around the barrel.
Figure 6:
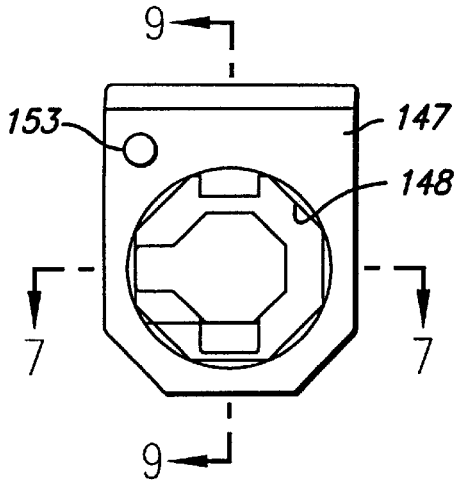
FIGS. 6–14 are different views of components of the charger device.
Figure 7:
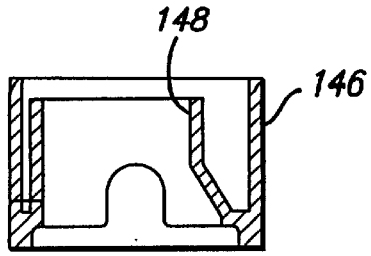
Figure 8:
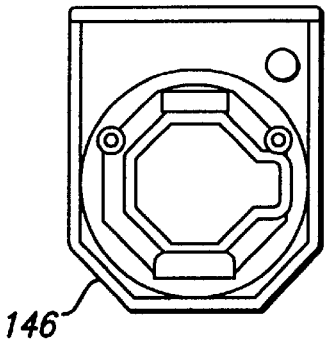
Figure 9:
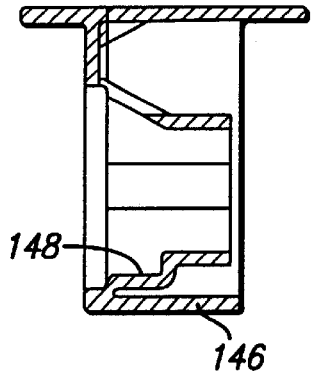
Figure 10:
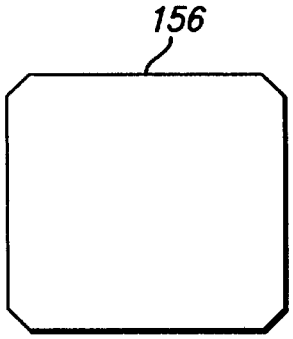
Figure 11:
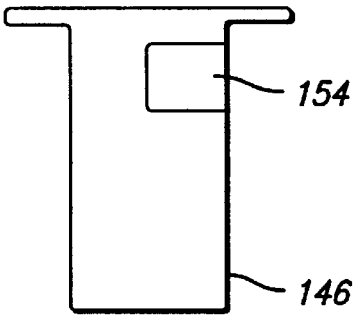

Above the body portion 10, which is a barrel, there is an intermediate portion 15 defined by a second cross-sectional area. The intermediate portion 15 is defined between the ends 16 and 17 of the arrows show in FIG. 1. Above the intermediate portion 15 there is a head portion 18 which is relatively enlarged, and is located in regular relationship relative to the barrel.

The head portion 18 includes a lens 19 and within the lens there is a bulb 20. There is also located a shroud 21 which is over-molded on the lens 19. This provides increased protection to the lens 19.

The body portion 10 includes a clip 122. The clip 122 is located substantially at the uppermost portion of the body portion 10 and extends downwardly along the surface towards the base portion 11 around the outside of the body portion 10. The clip 122 provides a receiving area 124 for receiving a support for the flashlight. The end of the clip 122 includes an inwardly directed lip 123 which closes the gap between the surface and the clip 122.

The intermediate portion 15 has a second cross-sectional area which is relatively larger than the first cross-sectional area of the body portion 10. The second cross-sectional area extends regularly relative to the longitudinal axis 29 running through the body portion 10. At the base 11 there is provided a longitudinal aperture 131 through which a manually operable movable switching arm and push button 132 of a switch device or assembly 133 is located. A switch pad button 233 cover is provided to the movable arm 32. The manually operable switch arm 32 can be depressed to activate a spring operated switch assembly so as to close and open electrical contacts in the switch device 133. The opposite end of the switch device 133 is connected with a helical spring 134.

Electrical contacts 34 are mounted as a pair adjacent each other and transversely in the extended intermediate portion 15 of the body, namely the intermediate portion below the head 18. The intermediate portion 15 includes a relatively tapered zone 35. The head portion 18 is formed such as to have a relatively greater cross-section that the cross-section than the intermediate portion 15. The location of the enlarged portion 18 is relatively centrally formed relative to the longitudinal axis 29.

The leading end of the switch device assembly 133 includes a centrally located helical spring 134, which is directed upwardly towards the battery pack 139. There are a pair of helical springs 140 mounted at the rear of a housing 141 for the bulb 20, these springs 140 contact the inside portion of contacts 34. There is also a central spring 234 directed downwardly from the housing 141 to the central stud 235. Between one of the springs 140 and stub 235 there is a connection which includes a diode 236. As such, the helical springs 134, 234 and 140 are in opposition to each other, and thereby suspend the battery pack 139 between the springs 134 and 234 in a shock-absorbing configuration.

There are also two contact strips 142 and 143, one of which, strip 142, connects with the helical spring 134 and runs up the inside side of the body 10. The strips 142 and 143 connect with the switch assembly 133 appropriately. The end of strip 143 connects electrically at the housing 141 with one side of the bulb 20.

Thus, when the operational arm and push button 132 of the switch 133 acts to press and depress the plunger mechanism 42 of the switch device assembly 133, the circuit connecting the battery between the bulb 20 is made or broken as established by the switch device assembly 133 and electrical contacts within the switch device assembly 133. It can be seen that the operation of the switch assembly 133 is longitudinal or relative to the longitudinal axis 29 of the body of the flashlight. The operational arm and push button 132 act longitudinally. The operational arm and push button 132 are located in a longitudinally position relative to the battery 139 of the flashlight.

A suitable cover 233 is provided to the push button 132 such as to provide for positive engagement by finger operation of a user. The outside of the flashlight is suitably protected for rugged use. Within the flashlight mechanism as indicated, the battery is suitably buffered for shock between the springs 134, 140 and 234.

The operation of the switch assembly in a manner longitudinal to the longitudinal direction of the flashlight also provides for effective and positive movement. By locating the switch in the base of the barrel of the flashlight, there is an effective cross-sectional area to accommodate the switch device in a convenient place.

The switch assembly 133 includes the plunger 42 which operates with one or more springs 45a and 45b which are helically mounted around or relative to the plunger 42. Suitable contact plates 46a and 46b are provided for opening and closing and making the flashlight circuit between the battery pack 139 and the bulb 20.

The charger 146 is a ring charger which circumferentially surrounds the barrel or body 10 of the flashlight. This effectively surrounds the flashlight and makes contact with the flashlight around the body 10 and the intermediate section 15 of the flashlight. The ring charger 146 includes two ring-like components. There is a first component 147 which has a circular mouth 148. Extending towards the center of the mouth 148 there are two metallic stud or contacts 149 and 150, which are mounted respectively on springs 151 and 152 so that they are biased towards the center. The tips of the contacts 149 and 150 would be to engage the mating contacts on the intermediate section 15 of the flashlight.

On the element 147 of the ring housing 146, there is also located an LED 153 which indicates when the charger 146 is operating. As such, the ring 148 of the charger embraces the flashlight. There is a power socket 154 which extends from the element 147. There is also a mounting wall 155 against which the springs 151 and 152 bear. There is a back housing plate 156 to the device. Below the housing plate 147 there is a bottom housing 157 which has an octagonal configuration.

Figure 12:
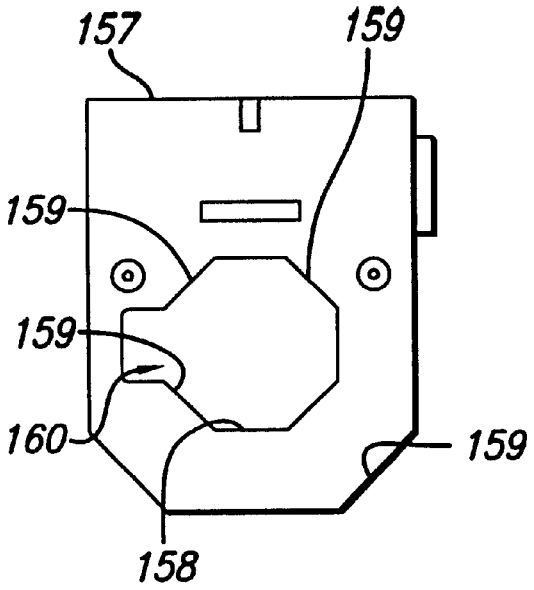
Figure 13:
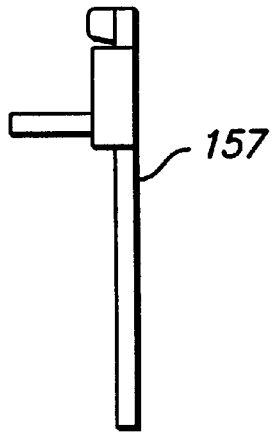
Figure 14:
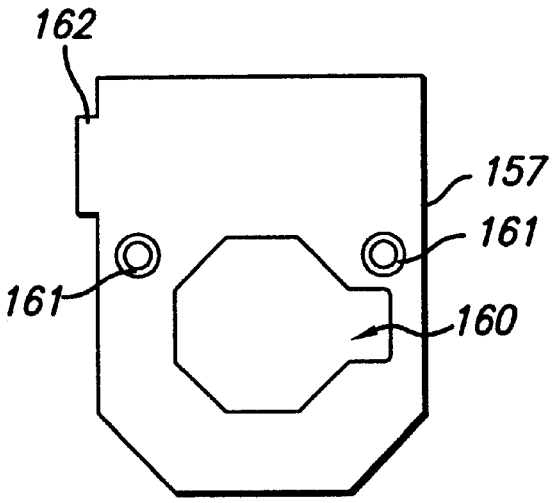
Figure 16:
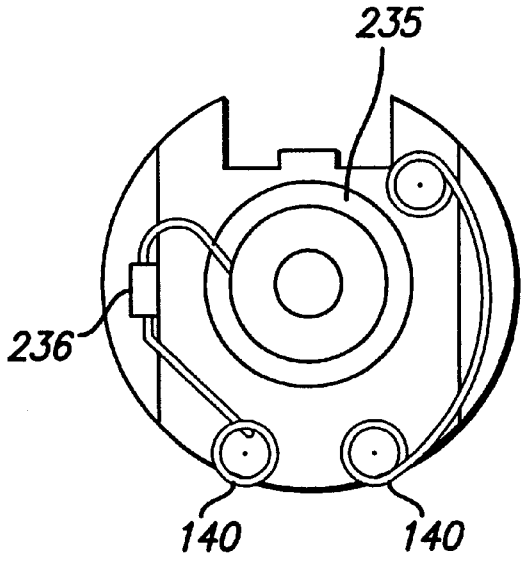
FIG. 16 is a rear view of the module showing the helical springs.
Figure 15:
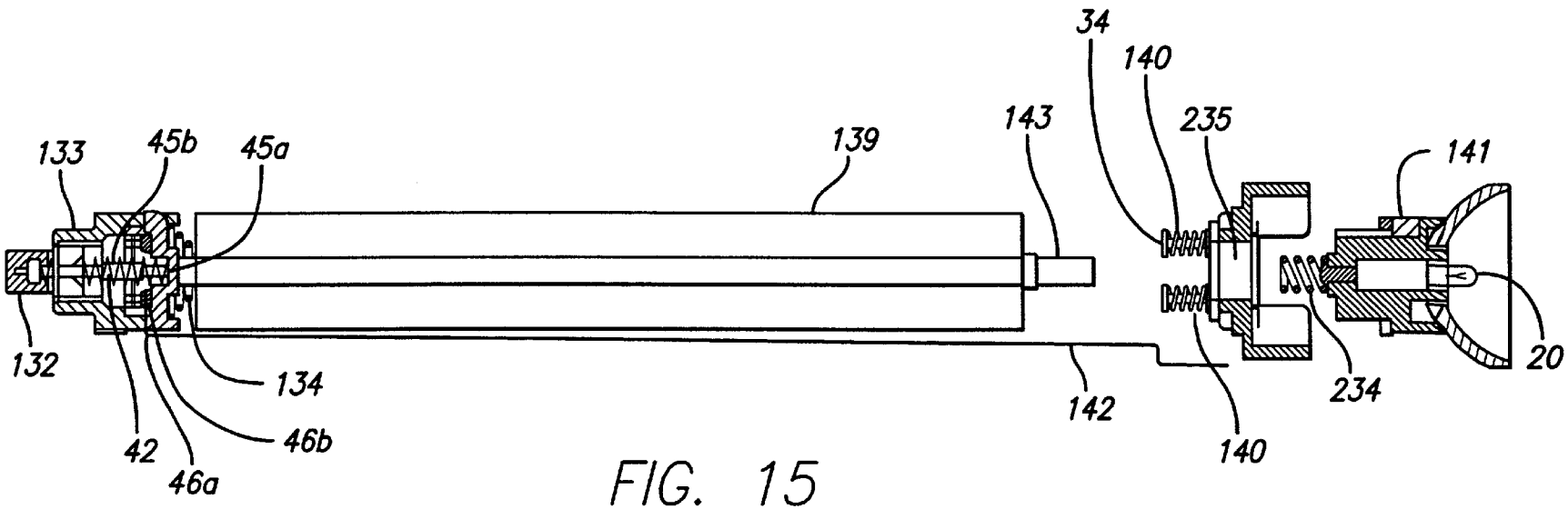
FIG. 15 is a side view of a switch device with metallic conductive strips for connecting the switch device, battery pack and housing for the bulb, showing the switch device, and a detailed view of the housing for the bulb and showing the multiple helical springs.

When viewed in plan as shown in FIGS. 12 and 13, it can be seen that the octagonal configuration has a short side 158, which is shorter relative to the sides 159 constituting the other portions of the octagonal housing. There is also a rectangular mouth 160 directed to one side of the octagonal receiving area in the plate 157. The plate also includes two screw holes 161 through which directed to receive the clip 23 extending from the intermediate section 15 down the outside surface of the body 10. In this manner the flashlight can be located in only the correct manner in the housing of the charger 146. The housing component 157 also contains a mounting wall 162 into which the charger component can rest. Within the charger housing 146 there is located a suitable mechanism for permitting recharge of the flashlight.

The ring engages the body portion 10 and the intermediate section 15 of the flashlight. The contacts 149 and 150 are located on the charger 46 so they engage the contacts 34 which are also positioned at the intermediate section 15 of the flashlight. The contacts 56 are spring loaded to extend outwardly into the area defined by the ring and towards the contacts 34 when located in position. The charger 46 includes conventional circuitry to act as a charger. It can be set up for connection with 120 volt main supply or 12 volt DC supply.

The ring conforms with a octagonal formation of the outside surface of the body 10. This permits for engagement in an embracing manner with the body 10. The inside surface 59 of the charger 46 also provides a mating interface with the octagonal surface 13. The mating surface 59 on the body of the charger 46 is such that eight sides of the octagonal formation 13 are embraced when the body 10 is in position properly in the charger 46. This permits for a firm location of the flashlight 10 in the charger 46 when recharging is to be affected.

Many other forms of the invention exist, each differing from the other in matters of detail only.

For instance, instead of having the contacts 34 located on the intermediate portion 15, namely below the head 18, it is possible to have a configuration where the contacts are on the body portion, namely the narrower body portion. In other cases, the recharging device may be formed with a mechanism of a pair of articulating jaws. Alternatively, only one jaw may articulate, and the other may be stationary in some situations.

The body 10 itself may be formed from material sufficiently sturdy to be resilient to shock. There can be situations without a shock-absorbing shroud around the lens. Instead of helical springs on either side of the rechargeable battery which can be of a nickel-cadmium configuration, there can be different spring formations to provide effective shock absorbing characteristics to either side of the battery.

The clip 122 and irregular surface 14 act as a centering protrusion in the charger 46. This slot and protrusion can be located between the respective contacts 34 and they facilitate alignment of the flashlight in the charger 46.

Generally, the configuration of the components is of the nature that the units are relatively water impermeable and, in this manner, the configuration of the components are tight fitting and of a material such that the ingress of water into the inner workings and compartments of the battery is relatively difficult under normal and even relatively rugged working conditions.

The invention is to be determined solely upon the following claims.

What is claimed is:

1. A rechargeable flashlight comprising:

a body for receiving a rechargeable battery, the body having a longitudinal axis and a top and a base;

a head on the body, the head having a lens and the head having a bulb;

a pair of contacts below the head for making connection with contacts on a charger device;

a switch device with electrical contacts, the switch device being located towards the base of the body, the switch device acting to move inwardly and outwardly to open and close an electric circuit between the battery and the bulb;

a first spring between the bulb and the battery top and a second spring between the battery bottom and the switch device, and the second spring being part of an electric connection between the battery bottom and the bulb;

the body including a barrel having a first cross-section and above the barrel there is a second portion extending with a second larger cross-section;

the second portion having a cross-section generally tapered along a longitudinal axis, and above the second portion of the second larger tapered cross-section there is a portion with a third larger cross-section, the third larger cross-section being the head on the body; and the pair contacts of the flashlight being on the second portion above the body of the flashlight and below the head.

2. A flashlight as claimed in claim 1 wherein the portion having the second larger cross-section extends generally equally about to one side of the longitudinal axis, and wherein the head extends substantially equally around the longitudinal axis.

3. A flashlight as claimed in claim 1 wherein the body includes a clip over an outer portion of the body.

4. A flashlight as claimed in claim 3 wherein the clip includes a length removed from the outside surface of the body and directed substantially parallel to the outside surface of the body, and includes a lip directed towards outside surface.

5. A flashlight as claimed in claim 1 wherein the barrel portion of the body includes a longitudinally extending aperture for receiving the switch device such that a manually operable portion of the switch devices extends to the longitudinal aperture and wherein the switch device is operable longitudinally inwardly and outwardly to activate and deactivate the switch.

6. A flashlight as claimed in claim 1 and a charger device for the flashlight, and wherein the charger device includes a circumferential ring housing for receiving the body of the flashlight about the portion of the flashlight constituting the intermediate portion.

7. A flashlight as claimed in claim 1 wherein the flashlight is front loaded with the rechargeable battery.

8. A flashlight as claimed in claim 1 wherein the switch device includes a manually operable switch extending longitudinally from the base of the flashlight and wherein the switch is spring operable to move outwardly and inwardly under manual action to activate the switch.

9. A flashlight as claimed in claim 1 including at least one contact strip extending between the bulb and the switch device, the contact strip acting to connect the bulb with the switch device.

10. A flashlight as claimed in claim 1 wherein in the head there is included a spring extending downwardly relative to the bulb towards the top of the battery and a spring extending upwardly from the base of the body to the battery.

11. A flashlight as claimed in claim 1 wherein the barrel includes an open end at the base, the open end being filled with a plug member having means for operating the switch device, and including an insulated cover over the plug member, the insulated cover member being engagable manually to operate the switch.

12. A flashlight as claimed in claim 1 wherein the body includes an outer surface having sides forming a cross-sectional octagonal form, and wherein a least one side of the octagonal form is of a different length relative to other sides of the octagonal form.

13. A rechargeable flashlight comprising:

a body for receiving a rechargeable battery, the body having a longitudinal axis and a top and a base;

a head on the body, the head having a lens and the head having a bulb;

a pair of contacts below the head for making connection with contacts on a charger device;

a switch device with electrical contacts, the switch device being located towards the base of the body, the switch device acting to move inwardly and outwardly to open and close an electric circuit between the battery and the bulb;

a first spring between the bulb and the battery top and a second spring between the battery bottom and the switch device, and the second spring being part of an electric connection between the battery bottom and the bulb; and the barrel portion of the body includes a longitudinally extending aperture for receiving the switch device such that a manually operable portion of the switch device extends to the longitudinal aperture and wherein the switch device is operable longitudinally inwardly and outwardly to activate and deactivate the switch; and wherein the pair of contacts of the flashlight are on an intermediate the body of the flashlight and below the head, and the intermediate portion being for receipt in a circumferential ring housing of a recharger device.

14. A flashlight as claimed in claim 13 and a clip over an outer portion of the body.

15. A flashlight as claimed in claim 14 wherein the clip includes a length removed from the outside surface of the body and directed substantially parallel to the outside surface of the body, and includes a lip directed towards outside surface.

16. A flashlight as claimed in claim 13 and a charger device for the flashlight, and wherein the charger device includes the circumferential ring housing for receiving the body of the flashlight about the portion of the flashlight constituting the intermediate portion.

17. A flashlight as claimed in claim 13 wherein the switch device includes a manually operable switch extending longitudinally from the base of the flashlight and wherein, the switch includes an insulated cover for engagement to manually operate the switch.

18. A flashlight as claimed in claim 13 wherein the body includes an outer surface having sides forming a cross-sectional octagonal form, and wherein at least one side is of a different length relative to the other sides of the octagonal form.

19. A rechargeable flashlight comprising:

a body for receiving a rechargeable battery, the body having a longitudinal axis and a top and a base;

a head on the body, the head having a lens and the head having a bulb;

a pair of contacts below the head for making connection with contacts on a charger device;

a switch device with electrical contacts, the switch device being located towards the base of the body, the switch device acting to move inwardly and outwardly to open and close an electric circuit between the battery and the bulb;

a first spring between the bulb and the battery top and a second spring between the battery bottom and the switch device, and the second spring being part of an electric connection between the battery bottom and the bulb; and the barrel portion of the body includes a longitudinally extending aperture for receiving the switch device such that a manually operable portion of the switch device extends to the longitudinal aperture and wherein the switch device is operable longitudinally inwardly and outwardly to activate and deactivate the switch;

wherein the pair of contacts of the flashlight are on an intermediate tapered portion above the body of the flashlight and below the head, and the intermediate portion being for receipt in a circumferential ring housing of a recharger device; and a clip over an outer portion of the body and extending into the second portion.

20. A flashlight as claimed in claim 19 wherein the clip includes a length removed from the outside surface of the body and directed substantially parallel to the outside surface of the body, and includes a lip directed towards outside surface, and wherein a circumferential ring housing of a charger device for receiving the body of the flashlight also receives the intermediate portion and the clip.

21. A flashlight as claimed in claim 19 wherein the switch device includes a manually operable switch extending longitudinally from the base of the flashlight and wherein, the switch includes an insulated cover for engagement to manually operate the switch.

22. A flashlight as claimed in claim 19 wherein the body includes an outer surface having sides forming a cross-sectional octagonal form, and wherein at least one side is of a different length relative to the other sides of the octagonal form.

23. A rechargeable flashlight comprising:

a body for receiving a rechargeable battery, the body having a longitudinal axis and a top and a base;

a head on the body, the head having a lens and the head having a bulb;

a pair of contacts below the head for making connection with contacts on a charger device;

a switch device with electrical contacts, the switch device being located towards the base of the body, the switch device acting to move inwardly and outwardly to open and close an electric circuit between the battery and the bulb;

a first spring between the bulb and the battery top and a second spring between the battery bottom and the switch device, and the second spring being part of an electric connection between the battery bottom and the bulb; and at least one conductive strip extending from the switch at the base of the body and a second conductive strip extending from the second spring at the base of the body to the housing for the bulb.

24. A rechargeable flashlight comprising:

a body for receiving a rechargeable battery, the body having a longitudinal axis and a top and a base;

a head on the body, the head having a lens and the head having a bulb;

a pair of contacts below the head for making connection with contacts on a charger device;

a switch device with electrical contacts, the switch device being located towards the base of the body, the switch device acting to move inwardly and outwardly to open and close an electric circuit between the battery and the bulb;

a first spring between the bulb and the battery top and a second spring between the battery bottom and the switch device, and the second spring being part of an electric connection between the battery bottom and the bulb; and a conductive strip extending from the switch at the base of the body to the first spring between the bulb and the battery top.

25. A flashlight as claimed in claim 1 including a conductive strip extending from the switch at the base of the body to the area adjacent to the bulb, and a second conductive strip extending from a spring at the base of the body towards the bulb.

26. A flashlight as claimed in claim 13 including a conductive strip extending from the switch at the base of the body to the area adjacent to the bulb, and a second conductive strip extending from a spring at the base of the body towards the bulb.

27. A flashlight as claimed in claim 19 including a conductive strip extending from the switch at the base of the body to the area adjacent to the bulb, and a second conductive strip extending from a spring at the base of the body towards the bulb.

* * * * *